US011337457B2

(12) United States Patent
Saygili

(10) Patent No.: US 11,337,457 B2
(45) Date of Patent: May 24, 2022

(54) AEROSOL-GENERATING SYSTEM HAVING AN OUTER HOUSING

(71) Applicant: Philip Morris Products S.A., Neuchatel (CH)

(72) Inventor: Ali Murat Saygili, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 337 days.

(21) Appl. No.: 16/461,641

(22) PCT Filed: Nov. 29, 2017

(86) PCT No.: PCT/EP2017/080869
§ 371 (c)(1),
(2) Date: May 16, 2019

(87) PCT Pub. No.: WO2018/099999
PCT Pub. Date: Jun. 7, 2018

(65) Prior Publication Data

US 2019/0350262 A1 Nov. 21, 2019

(30) Foreign Application Priority Data

Nov. 30, 2016 (EP) ..... 16201558

(51) Int. Cl.
*A24F 13/00* (2006.01)
*A24F 40/30* (2020.01)
(Continued)

(52) U.S. Cl.
CPC ..... *A24F 40/30* (2020.01); *A24F 7/00* (2013.01); *A24F 40/40* (2020.01); *H05B 3/44* (2013.01); *H05B 6/108* (2013.01); *A24F 40/20* (2020.01)

(58) Field of Classification Search
CPC ..... A24F 47/00
(Continued)

(56) References Cited

U.S. PATENT DOCUMENTS 10,791,760 B2 * 10/2020 Zuber ..... H05B 3/265
2009/0095311 A1 4/2009 Han
(Continued)

FOREIGN PATENT DOCUMENTS

AU 2014/270532 A1 11/2015
CN 201051862 Y 4/2008
(Continued)

OTHER PUBLICATIONS

International Search Report and Written Opinion dated Feb. 16, 2018 in PCT/EP2017/080869 filed on Nov. 29, 2017.
(Continued)

*Primary Examiner* — Phuong K Dinh
(74) *Attorney, Agent, or Firm* — Oblon, McClelland, Maier & Neustadt, L.L.P.

(57) ABSTRACT

There is provided an aerosol-generating system including an aerosol-generating device and a cartridge assembly, the device including a device inner housing defining a device cavity, an electrical heater, and a device outer housing; and the cartridge assembly including a cartridge assembly inner housing defining a substrate compartment, an aerosol-forming substrate positioned within the substrate compartment, and a cartridge assembly outer housing, and a portion of the cartridge assembly inner housing is configured to be received within the device cavity, and, when the portion of the cartridge assembly inner housing is received within the device cavity, at least a first part of a downstream edge of the device outer housing abuts at least a first part of an upstream edge of the cartridge assembly outer housing so that the
(Continued)

cartridge assembly outer housing and the device outer housing form a system outer housing.

13 Claims, 3 Drawing Sheets

(51) Int. Cl.

| | |
|---|---|
| ***A24F 7/00*** | (2006.01) |
| ***H05B 3/44*** | (2006.01) |
| ***H05B 6/10*** | (2006.01) |
| ***A24F 40/40*** | (2020.01) |
| *A24F 40/20* | (2020.01) |

(58) Field of Classification Search
USPC ..... 131/328–329
See application file for complete search history.

(56) References Cited

U.S. PATENT DOCUMENTS

| | | | |
|---|---|---|---|
| 2009/0126745 | A1 | 5/2009 | Hon |
| 2011/0209717 | A1 | 9/2011 | Han |
| 2013/0125906 | A1 | 5/2013 | Hon |
| 2013/0139833 | A1 | 6/2013 | Hon |
| 2013/0276798 | A1 | 10/2013 | Hon |
| 2014/0209110 | A1 | 7/2014 | Hon |
| 2014/0261493 | A1 | 9/2014 | Smith et al. |
| 2014/0261495 | A1 | 9/2014 | Novak, III et al. |
| 2015/0250230 | A1 | 9/2015 | Hon |
| 2015/0250231 | A1 | 9/2015 | Hon |
| 2015/0250232 | A1 | 9/2015 | Hon |
| 2015/0327597 | A1 | 11/2015 | Li et al. |
| 2016/0081395 | A1 | 3/2016 | Thorens et al. |
| 2016/0135504 | A1 | 5/2016 | Li et al. |
| 2016/0183593 | A1 | 6/2016 | Liu |
| 2016/0262458 | A1 | 9/2016 | Hon |
| 2016/0270448 | A1 | 9/2016 | Hon |
| 2016/0270449 | A1 | 9/2016 | Hon |
| 2016/0324219 | A1 | 11/2016 | Li et al. |
| 2017/0079326 | A1 | 3/2017 | Mironov |
| 2017/0095002 | A1 | 4/2017 | Silvestrini |
| 2017/0290373 | A1 | 10/2017 | Hon |

FOREIGN PATENT DOCUMENTS

| | | | |
|---|---|---|---|
| CN | 201064185 | Y | 5/2008 |
| CN | 103974635 | A | 8/2014 |
| CN | 204796750 | U | 11/2015 |
| CN | 204907927 | U | 12/2015 |
| CN | 105792688 | A | 7/2016 |
| CN | 105934171 | A | 9/2016 |
| CN | 107205496 | A | 9/2017 |
| CN | 107549880 | A | 1/2018 |
| EP | 2 022 350 | A1 | 2/2009 |
| EP | 2 944 207 | A1 | 11/2015 |
| EP | 3 095 338 | A1 | 11/2016 |
| GB | 2502052 | A | 11/2013 |
| JP | 2015-500026 | A | 1/2015 |
| JP | 2016-519937 | A | 7/2016 |
| JP | 2016-528874 | A | 9/2016 |
| RU | 103 281 | U1 | 4/2011 |
| TW | 201330884 | A1 | 8/2013 |
| TW | 201515587 | A | 5/2015 |
| WO | WO 2013/171206 | A1 | 11/2013 |
| WO | WO 2014/187770 | A2 | 11/2014 |
| WO | WO 2015/177253 | A1 | 11/2015 |
| WO | WO 2015/197627 | A1 | 12/2015 |
| WO | WO 2017/108721 | A1 | 6/2017 |

OTHER PUBLICATIONS

Extended European Search Report dated Jun. 16, 2017 in European Patent Application No. 16201558.0, citing documents AA, AB and AO therein, 5 pages.

Combined Russian Office Action and Search Report dated Mar. 24, 2021 in corresponding Russian Patent Application No. 2019117604/03(033730) (with English Translation) citing documents AA and AO therein, 19 pages.

Combined Chinese Office Action and Search Report dated Aug. 3, 2021 in Chinese Patent Application No. 201780068598.X (with English translation), citing documents AJ-AV therein, 16 pages.

Notification of Reasons for Refusal dated Dec. 6, 2021 in Japanese Patent Application No. 2019-529261 (with English language translation), 9 pages.

* cited by examiner

AEROSOL-GENERATING SYSTEM HAVING AN OUTER HOUSING

CROSS-REFERENCE TO RELATED APPLICATIONS

This application is a U.S. national stage application of PCT/EP2017/080869, filed on Nov. 29, 2017, which is based upon and claims the benefit of priority from European patent application no. 16201558.0, filed Nov. 30, 2016, the entire contents of each of which are incorporated herein by reference.

TECHNICAL FIELD

The present invention relates to an aerosol-generating system comprising an aerosol-generating device and a cartridge assembly each comprising an outer housing forming part of a system outer housing.

DESCRIPTION OF THE RELATED ART

Known handheld aerosol-generating systems typically comprise an aerosol-generating device comprising a battery, control electronics and an electric heater for heating an aerosol-generating article designed specifically for use with the aerosol-generating device. In some examples, the aerosol-generating article comprises an aerosol-forming substrate, such as a tobacco rod or a tobacco plug, and the heater contained within the aerosol-generating device is inserted into or around the aerosol-forming substrate when the aerosol-generating article is inserted into the aerosol-generating device.

In an alternative aerosol-generating system, the aerosol-generating article may comprise a capsule containing an aerosol-forming substrate, such as loose tobacco.

In another alternative aerosol-generating system, the aerosol-generating article may comprise a cartridge assembly in which the aerosol-forming substrate comprises a nicotine source and an acid source. In use, the nicotine and the acid are reacted with one another in the gas phase to form an aerosol of nicotine salt particles that is inhaled by the user.

In known aerosol-generating systems it may be difficult for a user to combine an aerosol-generating article with an aerosol-generating device, or to remove an aerosol-generating article from an aerosol-generating device. For example, some known aerosol-generating devices comprise a cavity from which it may be difficult for a user to remove an aerosol-generating article.

It would be desirable to provide an aerosol-generating system that facilitates improved handling of an aerosol-generating article by a user.

SUMMARY

According to the present invention there is provided an aerosol-generating system comprising an aerosol-generating device and a cartridge assembly. The aerosol-generating device comprises a device inner housing defining a device cavity, an electrical heater, and a device outer housing. The cartridge assembly comprises a cartridge assembly inner housing defining a substrate compartment, an aerosol-forming substrate positioned within the substrate compartment, and a cartridge assembly outer housing. A portion of the cartridge assembly inner housing is configured to be received within the device cavity. When the portion of the cartridge assembly inner housing is received within the device cavity, at least a first part of a downstream edge of the device outer housing abuts at least a first part of an upstream edge of the cartridge assembly outer housing so that the cartridge assembly outer housing and the device outer housing form a system outer housing.

BRIEF DESCRIPTION OF THE DRAWINGS

Embodiments of the invention will now be described, by way of example only, with reference to the accompanying drawings, in which.

DETAILED DESCRIPTION

Figure 1:
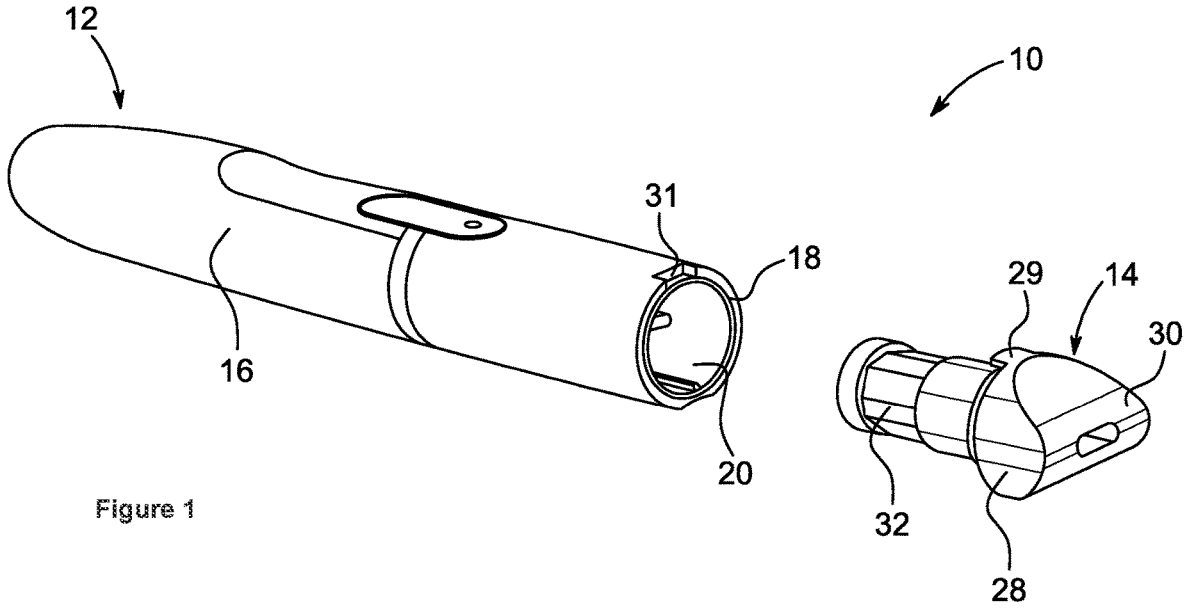
FIG. 1 shows a perspective view of an aerosol-generating system according to a first embodiment of the present invention.

As used herein, the term "aerosol-forming substrate" is used to describe a substrate capable of releasing volatile compounds, which can form an aerosol. The aerosols generated from aerosol-forming substrates of cartridge assembly assemblies according to the invention may be visible or invisible and may include vapours (for example, fine particles of substances, which are in a gaseous state, that are ordinarily liquid or solid at room temperature) as well as gases and liquid droplets of condensed vapours.

As used herein, the terms "upstream" and "downstream" are used to describe the relative positions of components, or portions of components, of aerosol-generating systems in relation to the direction of air drawn through the aerosol-generating systems during use. During use air is drawn in a downstream direction, from an upstream portion of the aerosol-generating system.

Advantageously, the aerosol-generating system according to the present invention comprises a cartridge assembly having an outer housing that forms part of the system outer housing, which may facilitate grasping of the cartridge assembly by a user.

At least a first part of a downstream edge of a device outer housing abuts at least a first part of an upstream edge of the cartridge assembly outer housing when a portion of the cartridge assembly inner housing is received within the device cavity. Advantageously, this may facilitate correct insertion of the cartridge assembly inner housing into the device cavity by a user. When the first part of the downstream edge of the device outer housing abuts the first part of the upstream edge of the cartridge assembly outer housing, the user knows that the cartridge assembly inner housing has been fully inserted into the device cavity. When the first part of the downstream edge of the device outer housing abuts the first part of the upstream edge of the cartridge assembly outer housing, further insertion of the cartridge assembly inner housing into the device cavity is prevented.

The device cavity may be configured to receive only a portion of the cartridge assembly inner housing. The device cavity may be configured to receive substantially the entire cartridge assembly inner housing.

The cartridge assembly may comprise a mouthpiece and a cartridge, wherein the cartridge comprises the aerosol-forming substrate. Advantageously, providing a mouthpiece as part of the cartridge assembly may facilitate hygienic use of the aerosol-generating system. Providing the mouthpiece as part of the cartridge assembly ensures that the mouthpiece is discarded and replaced with a new mouthpiece when the cartridge assembly is discarded and replaced with a new cartridge assembly.

Preferably, the cartridge comprises the cartridge assembly inner housing and the mouthpiece comprises the cartridge assembly outer housing, wherein the cartridge is positioned within the mouthpiece. Advantageously, providing and combining a separate mouthpiece and cartridge to form the cartridge assembly may facilitate manufacture of the cartridge assembly. For example, cartridge can be constructed with a shape that facilitates filling of the cartridge assembly inner housing with the aerosol-forming substrate during manufacture, and the mouthpiece can be constructed with a shape that facilitates cooperation with the device outer housing when the cartridge assembly is combined with the aerosol-generating device.

Preferably, the mouthpiece comprises a mouthpiece air outlet extending through the cartridge assembly outer housing.

The cartridge assembly may have a length of between about 32 millimetres and about 40 millimetres, preferably between about 33 millimetres and about 39 millimetres, more preferably between about 34 millimetres and about 38 millimetres, more preferably between about 35 millimetres and about 37 millimetres.

When the first part of the downstream edge of the device outer housing abuts the first part of the upstream edge of the cartridge assembly outer housing, preferably the overlap between the cartridge assembly and the aerosol-generating device is between about 10 percent and about 100 percent of the length of the cartridge assembly. Preferably, the overlap between the cartridge assembly and the aerosol-generating device is between about 20 percent and about 99 percent, more preferably between about 30 percent and about 98 percent, more preferably between about 40 percent and about 97 percent, more preferably between about 50 percent and about 96 percent, more preferably between about 60 percent and about 95 percent, more preferably between about 70 percent and about 90 percent, more preferably between about 75 percent and about 85 percent of the length of the cartridge assembly.

The upstream edge of the cartridge assembly outer housing may be formed by an upstream edge of the mouthpiece. Substantially all of the cartridge assembly outer housing may form the mouthpiece.

The mouthpiece may be formed by only a first portion of the cartridge assembly outer housing. The mouthpiece may extend downstream from a second portion of the cartridge assembly outer housing, wherein the upstream edge of the cartridge assembly outer housing is formed by an upstream edge of the second portion of the cartridge assembly outer housing.

Preferably, one of the downstream edge of the device outer housing and the upstream edge of the cartridge assembly outer housing comprises a guide slot, wherein the other of the downstream edge of the device outer housing and the upstream edge of the cartridge assembly outer housing comprises a guide projection. The guide slot is configured to receive the guide projection when the at least a portion of the cartridge assembly inner housing is received within the device cavity. Advantageously, the combination of a guide slot and a guide projection may facilitate insertion of the cartridge assembly inner housing into the device cavity in the correct orientation.

The aerosol-generating system may comprise a single guide slot and a single guide projection.

The aerosol-generating system may comprise a plurality of guide slots and a plurality of guide projections, wherein each guide slot is configured to receive one of the guide projections. All of the guide slots may be provided by the device outer housing. All of the guide slots may be provided by the cartridge assembly outer housing. Some of the guide slots may be provided by the device outer housing and some of the guide slots may be provided by the cartridge assembly outer housing. Preferably, the plurality of guide slots and the plurality of guide projections are configured so that each guide projection can be received in a corresponding guide slot only in a single orientation of the cartridge assembly with respect to the aerosol-generating device. The guide slots and the guide projections may be positioned about the outer housings of the aerosol-generating device and the cartridge assembly with a rotational asymmetry.

At least a portion of the device outer housing may overlie the device inner housing so that at least a portion of the downstream edge of the device outer housing is flush with at least a portion of a downstream edge of the device inner housing.

Advantageously, such embodiments may substantially reduce the risk of a user contacting the device inner housing when the cartridge assembly is removed from the aerosol-generating device, which may be desirable if the device inner housing becomes hot during operation of the aerosol-generating system.

Advantageously, such embodiments may minimise the size of the cartridge assembly outer housing, which may minimise the amount of waste when the cartridge assembly is discarded after use.

At least a portion of the cartridge assembly outer housing may overlie at least a portion of the cartridge assembly inner housing to define a cartridge assembly cavity between the cartridge assembly outer housing and the cartridge assembly inner housing. The aerosol-generating system is configured so that at least a portion of the device inner housing is received within the cartridge assembly cavity when the at least a portion of the cartridge assembly inner housing is received within the device cavity.

Advantageously, such embodiments may increase the length of the cartridge assembly outer housing, which may facilitate handling of the cartridge assembly by a user. In embodiments in which part of the cartridge assembly outer housing defines a mouthpiece, increasing the length of the cartridge assembly outer housing may advantageously facilitate handling of the cartridge assembly without touching the mouthpiece.

Preferably, the aerosol-generating device comprises a device airflow inlet extending through the device inner housing and in fluid communication with the device cavity. The aerosol-generating device may comprise a single device airflow inlet. The aerosol-generating device may comprise a plurality of device airflow inlets.

The aerosol-generating system may be configured so that, during use, airflow entering the device cavity through the device airflow inlet bypasses the cartridge assembly. That is, during use, the airflow entering the device cavity does not flow through the cartridge assembly. In such embodiments, the device airflow inlet is a ventilation air inlet.

The aerosol-generating system may be configured so that, during use, airflow entering the device cavity through the device airflow inlet flows through the substrate compartment of the cartridge assembly. In such embodiments, the device airflow inlet is a mainstream air inlet.

The aerosol-generating system may be configured so that, during use, some of the airflow entering the device cavity through the device airflow inlet bypasses the cartridge assembly, and some of the airflow entering the device cavity through the device airflow inlet flows through the substrate compartment of the cartridge assembly. In such embodiments, the device airflow inlet functions as a combined air inlet.

In embodiments in which the aerosol-generating device comprises a plurality of device airflow inlets, the plurality of device airflow inlets may comprise ventilation air inlets, mainstream air inlets, combined air inlets, and combinations thereof.

The device airflow inlet may comprise a first airflow inlet configured for fluid communication with an upstream end of the substrate compartment when the at least a portion of the cartridge assembly inner housing is received within the device cavity, and wherein the device airflow inlet comprises a second airflow inlet configured for fluid communication with a downstream end of the substrate compartment when the at least a portion of the cartridge assembly inner housing is received within the device cavity. The first airflow inlet may be a mainstream air inlet and the second airflow inlet may be a ventilation air inlet. The first and second airflow inlets may be the same airflow inlet and comprising a combined air inlet.

Preferably, the aerosol-generating system comprises a system airflow inlet extending through the system outer housing. In embodiments in which the aerosol-generating device comprises at least one device airflow inlet, preferably the system airflow inlet is in fluid communication with the at least one device airflow inlet.

The aerosol-generating system may comprise a single system airflow inlet. The aerosol-generating device may comprise a plurality of system airflow inlets.

The system airflow inlet may comprise an aperture extending through the device outer housing. The system airflow inlet may comprise an aperture extending through the cartridge assembly outer housing.

The aerosol-generating system may be configured so that, when the first part of the downstream edge of the device outer housing abuts the first part of the upstream edge of the cartridge assembly outer housing, a second part of the downstream edge of the device outer housing is spaced apart from a second part of the upstream edge of the cartridge assembly outer housing to define the system airflow inlet between the second part of the downstream edge of the device outer housing and the second part of the upstream edge of the cartridge assembly outer housing.

Preferably, the aerosol-generating system comprises a system airflow outlet in fluid communication with at least one of the downstream end of the device cavity and the downstream end of the substrate compartment. In embodiments in which the cartridge assembly outer housing defines a mouthpiece having a mouthpiece air outlet, preferably the mouthpiece air outlet forms a system airflow outlet.

The aerosol-generating system may comprise a single system airflow outlet. The aerosol-generating device may comprise a plurality of system airflow outlets.

The aerosol-forming substrate may comprise a solid aerosol-forming substrate. The aerosol-forming substrate may comprise tobacco. The aerosol-forming substrate may comprise a tobacco-containing material containing volatile tobacco flavour compounds which are released from the substrate upon heating. The aerosol-forming substrate may comprise a non-tobacco material. The aerosol-forming substrate may comprise tobacco-containing material and non-tobacco containing material.

The aerosol-forming substrate may include at least one aerosol-former. Suitable aerosol-formers include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Preferred aerosol formers are polyhydric alcohols or mixtures thereof, such as propylene glycol, triethylene glycol, 1,3-butanediol and, most preferred, glycerine.

The aerosol-forming substrate may comprise a single aerosol former. The aerosol-forming substrate may comprise a combination of two or more aerosol formers.

The aerosol-forming substrate may have an aerosol former content of greater than approximately 5 percent on a dry weight basis.

The aerosol-forming substrate may have an aerosol former content of between approximately 5 percent and approximately 30 percent on a dry weight basis.

The aerosol-forming substrate may have an aerosol former content of approximately 20 percent on a dry weight basis.

The aerosol-forming substrate may comprise a nicotine source positioned within the substrate compartment.

The aerosol-forming substrate may comprise a liquid aerosol-forming substrate. The liquid aerosol-forming substrate may comprise a nicotine solution. The liquid aerosol-forming substrate may comprise a tobacco-containing material comprising volatile tobacco flavour compounds which are released from the liquid upon heating. The liquid aerosol-forming substrate may comprise a non-tobacco material. The liquid aerosol-forming substrate may include water, solvents, ethanol, plant extracts and natural or artificial flavours. The liquid aerosol-forming substrate may further comprise an aerosol former.

Preferably, the liquid aerosol-forming substrate is impregnated into a carrier material positioned within the substrate compartment.

Preferably, the carrier material has a density of between about 0.1 grams/cubic centimetre and about 0.3 grams/cubic centimetre.

Preferably, the carrier material has a porosity of between about 15 percent and about 55 percent.

The carrier material may comprise one or more of glass, cellulose, ceramic, stainless steel, aluminium, polyethylene (PE), polypropylene, polyethylene terephthalate (PET), poly (cyclohexanedimethylene terephthalate) (PCT), polybutylene terephthalate (PBT), polytetrafluoroethylene (PTFE), expanded polytetrafluoroethylene (ePTFE), and BAREX®.

Preferably, the carrier material is chemically inert with respect to the liquid aerosol-forming material.

The substrate compartment may be a single substrate compartment. The aerosol-forming substrate may comprise at least one of a solid aerosol-forming substrate and a liquid aerosol-forming substrate, as described herein.

The substrate compartment may comprise a first substrate compartment and a second substrate compartment, wherein the aerosol-forming substrate comprises a nicotine source positioned within the first substrate compartment and an acid source positioned within the second substrate compartment.

The nicotine source may comprise at least one of nicotine, nicotine base or a nicotine salt.

The nicotine source may comprise a first carrier material impregnated with nicotine. Suitable carrier materials are described herein. The nicotine source may comprise a first carrier material impregnated with between about 1 milligram and about 50 milligrams of nicotine. The nicotine source may comprise a first carrier material impregnated with between about 1 milligram and about 40 milligrams of nicotine. Preferably, the nicotine source comprises a first carrier material impregnated with between about 3 milligrams and about 30 milligrams of nicotine. More preferably, the nicotine source comprises a first carrier material impregnated with between about 6 milligrams and about 20 milligrams of nicotine. Most preferably, the nicotine source comprises a first carrier material impregnated with between about 8 milligrams and about 18 milligrams of nicotine.

In embodiments in which the first carrier material is impregnated with nicotine base or a nicotine salt, the amounts of nicotine recited herein are the amount of nicotine base or amount of ionised nicotine, respectively.

The first carrier material may be impregnated with liquid nicotine or a solution of nicotine in an aqueous or non-aqueous solvent.

The first carrier material may be impregnated with natural nicotine or synthetic nicotine.

The acid source may comprise an organic acid or an inorganic acid.

Preferably, the acid source comprises an organic acid, more preferably a carboxylic acid, most preferably an alpha-keto or 2-oxo acid or lactic acid.

The acid source may comprise an acid selected from the group consisting of 3-methyl-2-oxopentanoic acid, pyruvic acid, 2-oxopentanoic acid, 4-methyl-2-oxopentanoic acid, 3-methyl-2-oxobutanoic acid, 2-oxooctanoic acid, lactic acid and combinations thereof. The acid source may comprise pyruvic acid or lactic acid. Preferably, the acid source comprises lactic acid.

The acid source may comprise a second carrier material impregnated with acid. Suitable carrier materials are described herein. The acid source may be a lactic acid source comprising a second carrier material impregnated with between about 2 milligrams and about 60 milligrams of lactic acid. Preferably, the lactic acid source comprises a second carrier material impregnated with between about 5 milligrams and about 50 milligrams of lactic acid. More preferably, the lactic acid source comprises a second carrier material impregnated with between about 8 milligrams and about 40 milligrams of lactic acid. Most preferably, the lactic acid source comprises a second carrier material impregnated with between about 10 milligrams and about 30 milligrams of lactic acid.

The first carrier material and the second carrier material may be the same or different. Advantageously, the first carrier material is chemically inert with respect to nicotine. Advantageously, the second carrier material is chemically inert with respect to the acid.

The cartridge assembly may further comprise a flavourant. Preferably, the flavourant is positioned within the substrate compartment. In embodiments in which the aerosol-forming substrate comprises a liquid impregnated into a carrier material, preferably the flavourant is a liquid flavourant impregnated into the carrier material. Suitable flavourants include, but are not limited to, menthol.

The cartridge assembly inner housing may further define a heating compartment.

The electrical heater may comprise a resistive heating element positioned within the device cavity, wherein the heating compartment is configured to receive the resistive heating element when the at least a portion of the cartridge assembly inner housing is received within the device cavity.

The electrical heater may comprise an inductive heating element, wherein the cartridge assembly further comprises a susceptor positioned within the heating compartment.

Preferably, the aerosol-generating device further comprises an electrical power supply configured to supply electrical power to the electrical heater. The electrical power supply may comprise a direct current (DC) source. In preferred embodiments, the electrical power supply comprises a battery. The electrical power supply may comprise a Nickel-metal hydride battery, a Nickel cadmium battery, or a Lithium based battery, for example a Lithium-Cobalt, a Lithium-Iron-Phosphate or a Lithium-Polymer battery.

Preferably, the aerosol-generating device further comprises a controller configured to control a supply of electrical power from the electrical power supply to the electrical heater.

The device inner housing, the device outer housing, the cartridge assembly inner housing and the cartridge assembly outer housing may be formed from any suitable material or combination of materials. Suitable materials include, but are not limited to, aluminium, polyether ether ketone (PEEK), polyimides, such as Kapton®, polyethylene terephthalate (PET), polyethylene (PE), high-density polyethylene (HDPE), polypropylene (PP), polystyrene (PS), fluorinated ethylene propylene (FEP), polytetrafluoroethylene (PTFE), polyoxymethylene (POM), epoxy resins, polyurethane resins, vinyl resins, liquid crystal polymers (LCP) and modified LCPs, such as LCPs with graphite or glass fibres.

The device inner housing, the device outer housing, the cartridge assembly inner housing and the cartridge assembly outer housing may be formed from the same or different materials.

The cartridge assembly inner housing may be formed from one or more materials that are nicotine-resistant. The cartridge assembly inner housing may be formed from one or more materials that are acid-resistant.

The substrate compartment of the cartridge assembly may be coated with one or more nicotine-resistant materials. In embodiments in which the substrate compartment comprises a first substrate compartment and a second substrate compartment, the first substrate compartment may be coated with one or more nicotine-resistance materials and the second substrate compartment may be coated with one or more acid-resistant materials.

Examples of suitable nicotine-resistant materials and acid-resistant materials include, but are not limited to, polyethylene (PE), polypropylene (PP), polystyrene (PS), fluorinated ethylene propylene (FEP), polytetrafluoroethylene (PTFE), epoxy resins, polyurethane resins, vinyl resins and combinations thereof.

Use of one or more nicotine-resistant materials may advantageously enhance the shelf life of the cartridge assembly.

Use of one or more acid-resistant materials may advantageously enhance the shelf life of the cartridge assembly.

Figure 2:
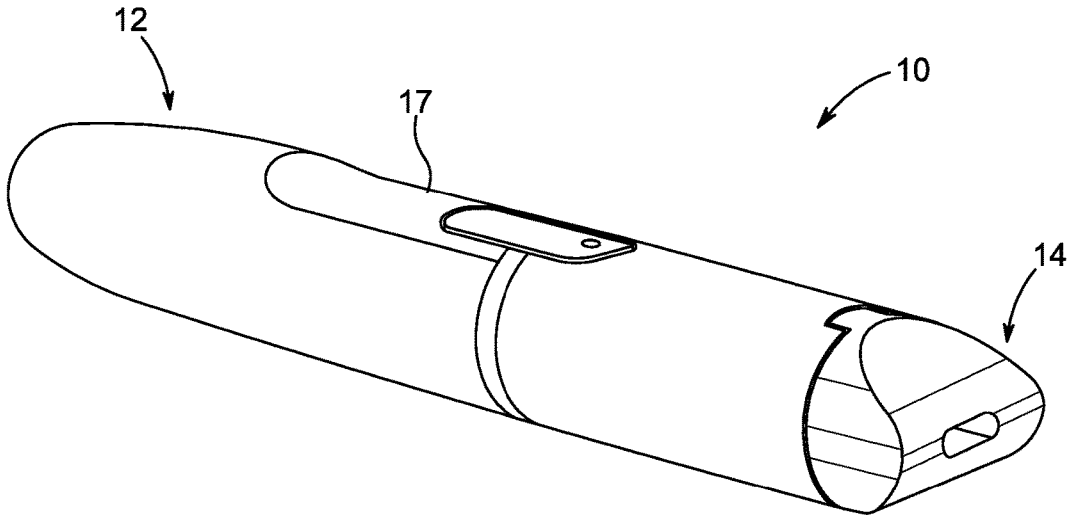
FIG. 2 shows the aerosol-generating system of FIG. 1 with the cartridge assembly coupled to the aerosol-generating device.
Figure 3:
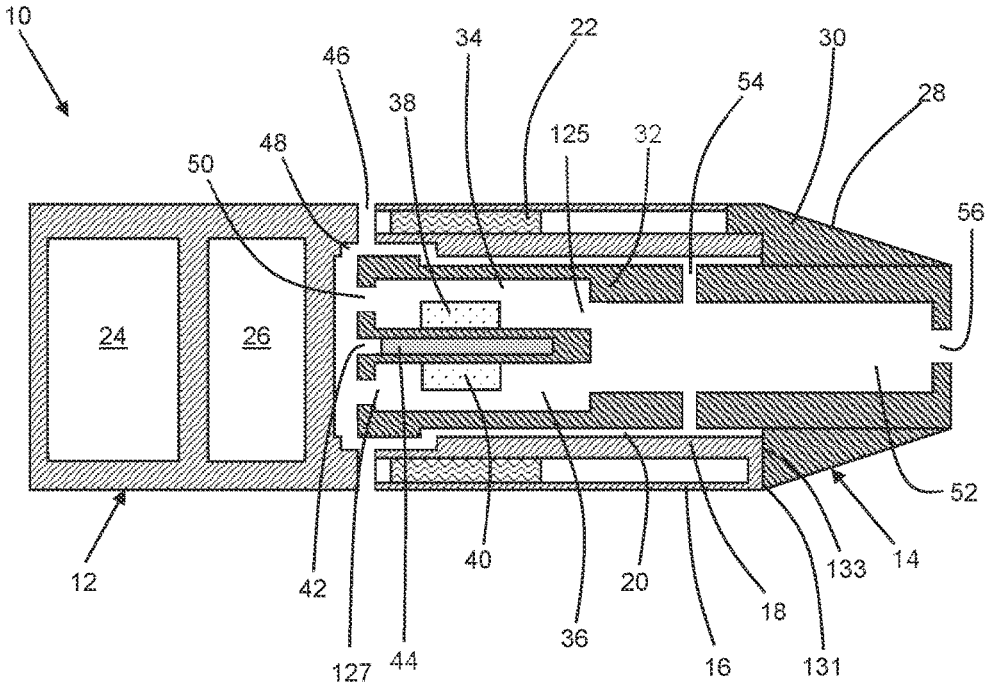
FIG. 3 shows a schematic cross-sectional view of the aerosol-generating system of FIG. 2.

FIG. 1 shows an aerosol-generating system 10 according to a first embodiment of the present invention. The aerosol-generating system 10 comprises an aerosol-generating device 12 and a cartridge assembly 14. FIGS. 2 and 3 show the cartridge assembly 14 coupled to the aerosol-generating device 12.

The aerosol-generating device comprises a device outer housing 16, and a device inner housing 18 that defines a device cavity 20 for receiving a portion of the cartridge assembly 14. As shown in FIG. 3, which shows a schematic cross-sectional view of the aerosol-generating system 10, the aerosol-generating device 12 further comprises an electrical heater 22, an electrical power supply 24, and a controller 26 for controlling a supply of electrical power from the electrical power supply 24 to the electrical heater 22. The electrical heater 22 is an annular inductive heater and the electrical power supply 24 is a rechargeable battery.

The cartridge assembly 14 comprises a cartridge assembly outer housing 28 that forms a mouthpiece 30 at a downstream end of the cartridge assembly 14. The cartridge assembly outer housing 28 also forms a guide projection 29 configured for insertion into a guide slot 31 formed by the device outer housing 16 to ensure correct rotational orientation of the cartridge assembly 14 with respect to the aerosol-generating device 12. When the cartridge assembly 14 is coupled to the aerosol-generating device 12 an upstream edge of the cartridge assembly outer housing 28 abuts a downstream edge of the device outer housing 16. The cartridge assembly outer housing 28 and the device outer housing 16 together form a system outer housing 17.

A cartridge assembly inner housing 32 is configured for insertion into the device cavity 20 of the aerosol-generating device 12. The cartridge assembly inner housing 32 defines a substrate compartment comprising a first substrate compartment 34 and a second substrate compartment 36, the cartridge assembly 14 further comprising a first aerosol-forming substrate 38 positioned in the first substrate compartment 34 and a second aerosol-forming substrate 40 positioned in the second substrate compartment 36. The substrate compartment comprises an upstream end 127 and a downstream end 125. The first aerosol-forming substrate 38 comprises a nicotine source and the second aerosol-forming substrate 40 comprises an acid source.

The cartridge assembly inner housing 32 also defines a heating compartment 42, the cartridge assembly 14 comprising a susceptor 44 positioned within the heating compartment 42.

During use of the aerosol-generating system 10, the controller 26 controls a supply of electrical power from the electrical power supply 24 to the electrical heater 22 to energize the electrical heater 22. The electrical heater 22 inductively heats the susceptor 44, which heats the first and second aerosol-forming substrates 38, 40.

When a user draws on the downstream end of the aerosol-generating system 10 air is drawn into the aerosol-generating system 10 through system airflow inlets 46 extending through the device outer housing 16. Air entering the aerosol-generating system 10 through the system airflow inlets 46 enters the device cavity 20 via device airflow inlets 48 extending through the device inner housing 18. Each device airflow inlet 48 is a combined air inlet so that air entering through each device airflow inlet 48 is divided into ventilation air and mainstream air.

The mainstream air is directed to the upstream end of the device cavity 20 where it enters the first and second substrate compartments 34, 36 through cartridge assembly airflow inlets 50. As the mainstream air flows through the first and second substrate compartments 34, 36, nicotine vapour and acid vapour from the first and second aerosol-forming substrates 38, 40 are entrained in the mainstream air. The mainstream air containing the nicotine vapour and the acid vapour flows into a mixing chamber 52 at a downstream end of the cartridge assembly 14 where the nicotine vapour and the acid vapour react to form nicotine salt particles.

The ventilation air is directed towards the downstream end of the device cavity 20 where it enters the mixing chamber 52 via ventilation airflow inlets 54 extending through the cartridge assembly inner housing 32. In the mixing chamber 52, the ventilation air mixes with the mainstream air containing the nicotine salt particles to form an aerosol for delivery to the user. The aerosol flows out of the mixing chamber 52 via a mouthpiece airflow outlet 56, which forms a system airflow outlet.

At least a portion of the device outer housing 16 overlies the device inner housing 18 so that at least a portion 131 of the downstream edge of the device outer housing 16 is flush with at least a portion 133 of a downstream edge of the device inner housing 18.

Figure 4:
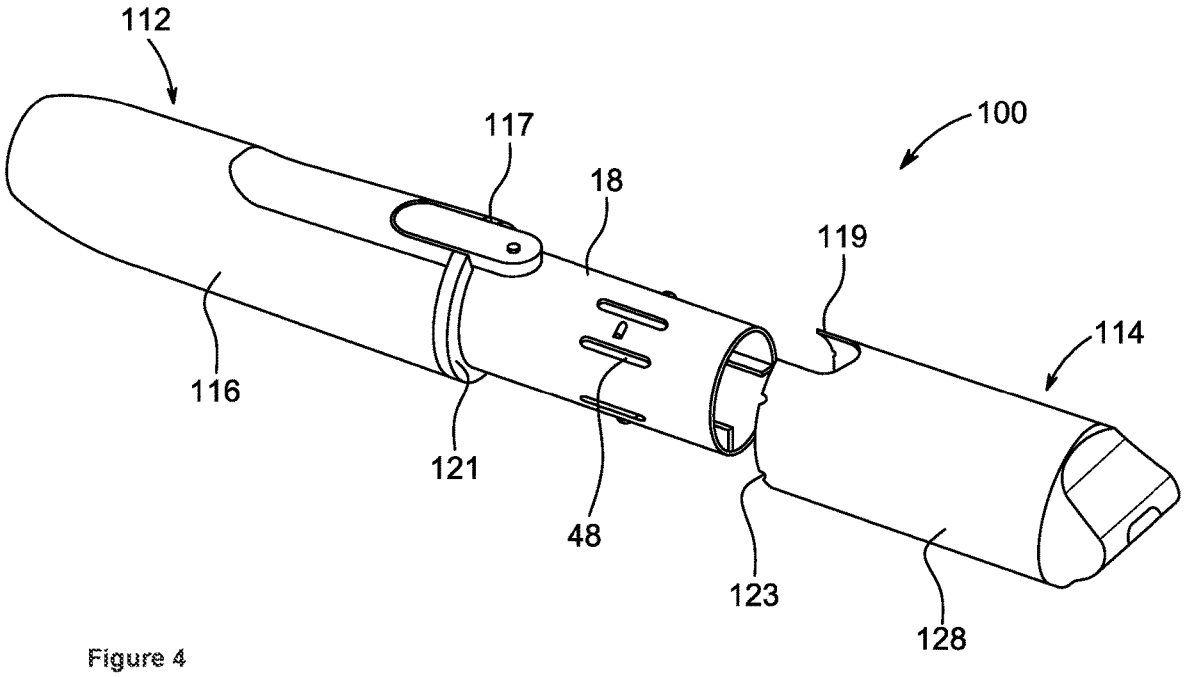
FIG. 4 shows a perspective view of an aerosol-generating system according to a second embodiment of the present invention.
Figure 5:
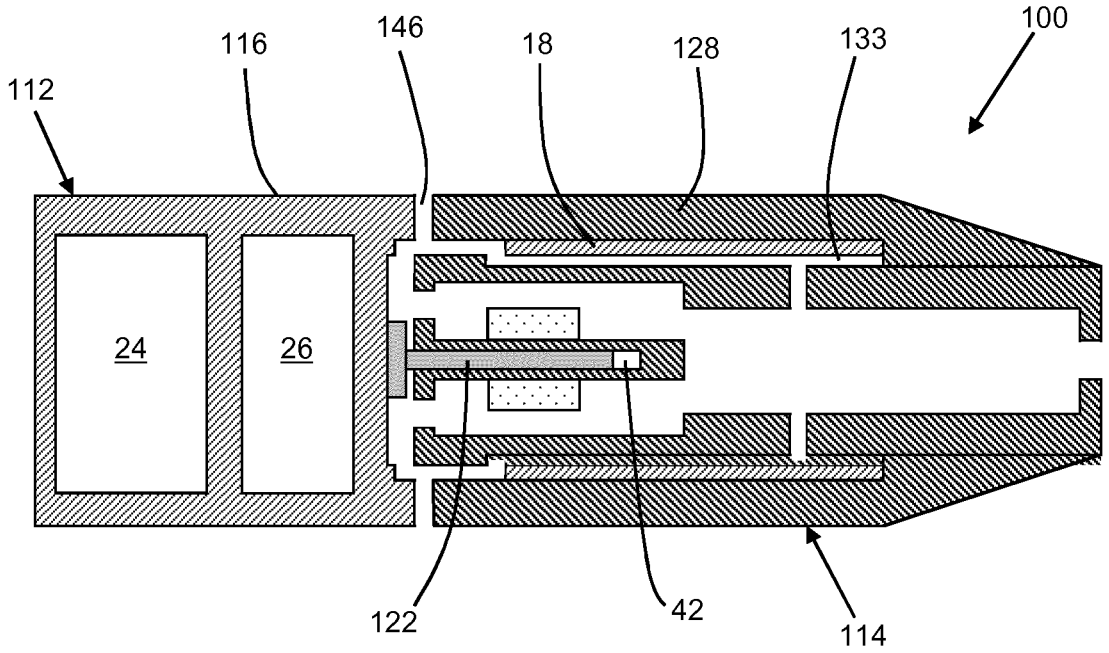
FIG. 5 shows a schematic cross-sectional view of the aerosol-generating system of FIG. 4.

FIG. 4 shows an aerosol-generating system 100 according to a second embodiment of the present invention. The construction of the aerosol-generating system 100 is similar to the construction of the aerosol-generating system 10 described with reference to FIGS. 1 to 3 and like reference numerals are used to designate like parts. Only the differences between the two aerosol-generating systems is described, and the operation of the two aerosol-generating systems is identical.

The aerosol-generating system 100 comprises an aerosol-generating device 112 comprising a device outer housing 116 that is shortened compared to the device outer housing 16 of the aerosol-generating system 10. Therefore, the device outer housing 116 does not overlie the device inner housing 18.

To accommodate the shortened device outer housing 116, the aerosol-generating system 100 comprises a cartridge assembly 114 having an elongated cartridge assembly outer housing 128 that overlies the cartridge assembly inner housing 32 to define a cartridge assembly cavity 133 between the cartridge assembly outer housing 128 and the cartridge assembly inner housing 32. When the cartridge assembly 114 is coupled to the aerosol-generating device 112, the device inner housing 18 is received in the cartridge assembly cavity 133.

In the aerosol-generating system 100, the system airflow inlets 146 are formed between the cartridge assembly outer housing 128 and the device outer housing 116 when the cartridge assembly 114 is coupled to the aerosol-generating device 112. The downstream edge of the device outer housing 116 and the upstream edge of the cartridge assembly outer housing 128 are shaped so that a first part 119 of the upstream edge of the cartridge assembly outer housing 128 abuts a first part 117 of the downstream edge of the device outer housing 116. The downstream edge of the device outer housing 116 and the upstream edge of the cartridge assembly outer housing 128 are shaped so that a second part 123 of the upstream edge of the cartridge assembly outer housing 128 is spaced apart from a second part 121 of the downstream edge of the device outer housing 116 to form the system airflow inlets 146 between the second parts of the upstream edge of the cartridge assembly outer housing 128 and the downstream edge of the device outer housing 116.

The aerosol-generating device 112 comprises an electrical heater 122, the electrical heater 122 comprising a resistive heating element extending into the device cavity 20 at an upstream end of the device cavity 20. The heating compartment 42 of the cartridge assembly 114 is configured to receive the electrical heater 122.

The invention claimed is:

1. An aerosol-generating system, comprising:

an aerosol-generating device, comprising:

a device inner housing defining a device cavity, a device airflow inlet extending through the device inner housing and being in fluid communication with the device cavity, an electrical heater, and a device outer housing; and a cartridge assembly, comprising:

a cartridge assembly inner housing defining a substrate compartment, an aerosol-forming substrate positioned within the substrate compartment, and a cartridge assembly outer housing, wherein a portion of the cartridge assembly inner housing is configured to be received within the device cavity, wherein, when the portion of the cartridge assembly inner housing is received within the device cavity, at least a first part of a downstream edge of the device outer housing abuts at least a first part of an upstream edge of the cartridge assembly outer housing so that the cartridge assembly outer housing and the device outer housing form a system outer housing, and wherein the device airflow inlet is configured for fluid communication with an upstream end of the substrate compartment and a downstream end of the substrate compartment when the at least a portion of the cartridge assembly inner housing is received within the device cavity.

2. The aerosol-generating system according to claim 1, wherein the cartridge assembly further comprises a mouthpiece and a cartridge, the cartridge comprising the aerosol-forming substrate.

3. The aerosol-generating system according to claim 2, wherein the cartridge comprises the cartridge assembly inner housing, wherein the mouthpiece comprises the cartridge assembly outer housing, and wherein the cartridge is positioned inside the mouthpiece.

4. The aerosol-generating system according to claim 1, wherein, when the first part of the downstream edge of the device outer housing abuts the first part of the upstream edge of the cartridge assembly outer housing, an overlap between the cartridge assembly and the aerosol-generating device is between 10 percent and 100 percent of a length of the cartridge assembly.

5. The aerosol-generating system according to claim 1, wherein one of the downstream edge of the device outer housing and the upstream edge of the cartridge assembly outer housing comprises a guide slot, wherein the other of the downstream edge of the device outer housing and the upstream edge of the cartridge assembly outer housing comprises a guide projection, and wherein the guide slot is configured to receive the guide projection when the at least a portion of the cartridge assembly inner housing is received within the device cavity.

6. The aerosol-generating system according to claim 1, wherein at least a portion of the device outer housing overlies the device inner housing so that at least a portion of the downstream edge of the device outer housing is flush with at least a portion of a downstream edge of the device inner housing.

7. The aerosol-generating system according to claim 1, wherein at least a portion of the cartridge assembly outer housing overlies at least a portion of the cartridge assembly inner housing to define a cartridge assembly cavity between the cartridge assembly outer housing and the cartridge assembly inner housing, and wherein the aerosol-generating system is configured so that at least a portion of the device inner housing is received within the cartridge assembly cavity when the at least a portion of the cartridge assembly inner housing is received within the device cavity.

8. The aerosol-generating system according to claim 1, wherein, when the first part of the downstream edge of the device outer housing abuts the first part of the upstream edge of the cartridge assembly outer housing, a second part of the downstream edge of the device outer housing is spaced apart from a second part of the upstream edge of the cartridge assembly outer housing to define a system airflow inlet between the second part of the downstream edge of the device outer housing and the second part of the upstream edge of the cartridge assembly outer housing.

9. The aerosol-generating system according to claim 1, wherein the aerosol-forming substrate comprises a nicotine source positioned within the substrate compartment.

10. The aerosol-generating system according to claim 9, wherein the substrate compartment comprises a first substrate compartment and a second substrate compartment, and wherein the aerosol-forming substrate comprises the nicotine source positioned within the first substrate compartment and an acid source positioned within the second substrate compartment.

11. The aerosol-generating system according to claim 1, wherein the cartridge assembly inner housing further defines a heating compartment.

12. The aerosol-generating system according to claim 11, wherein the electrical heater comprises a resistive heating element positioned within the device cavity, and wherein the heating compartment is configured to receive the resistive heating element when the at least a portion of the cartridge assembly inner housing is received within the device cavity.

13. The aerosol-generating system according to claim 11, wherein the electrical heater comprises an inductive heating element, and wherein the cartridge assembly further comprises a susceptor positioned within the heating compartment.

* * * * *